US005146135A

United States Patent [19]

Lagushenko

[11] Patent Number: 5,146,135

[45] Date of Patent: Sep. 8, 1992

[54] GLOW DISCHARGE LAMP HAVING ANODE PROBES

[75] Inventor: Radomir Lagushenko, Brookline, Mass.

[73] Assignee: GTE Products Corporation, Danvers, Mass.

[21] Appl. No.: 599,216

[22] Filed: Oct. 17, 1990

[51] Int. Cl.[5] ..... H01J 61/64; H01J 61/16

[52] U.S. Cl. ..... 313/619; 313/620; 313/631; 313/642; 313/345

[58] Field of Search ..... 313/619, 620, 631, 632, 313/642, 345, 346 R, 344, 491, 310

[56] References Cited

U.S. PATENT DOCUMENTS

| | | | |
|---|---|---|---|
| 2,067,129 | 1/1937 | Marden | 313/344 X |
| 2,959,702 | 11/1960 | Beese | 313/346 R X |
| 2,961,566 | 11/1960 | Waymouth et al. | 313/642 X |
| 3,013,175 | 12/1961 | Waymouth et al. | 313/632 X |
| 3,079,521 | 2/1963 | Clark | 313/493 X |
| 3,725,720 | 4/1973 | Petro et al. | 313/345 X |
| 3,814,971 | 6/1974 | Bhattacharya | 313/643 |
| 4,013,914 | 3/1977 | Clune et al. | 313/492 X |
| 4,408,141 | 10/1983 | Byszewski et al. | 313/310 X |
| 4,494,046 | 1/1985 | Budinger et al. | 313/632 X |
| 4,516,057 | 5/1985 | Proud et al. | 313/632 X |
| 4,518,897 | 5/1985 | Proud et al. | 313/632 X |
| 4,929,868 | 5/1990 | Bouchard | 313/619 |

FOREIGN PATENT DOCUMENTS

| | | | |
|---|---|---|---|
| 0225058 | 9/1989 | Japan | 313/619 |

*Primary Examiner*—Donald J. Yusko
*Assistant Examiner*—Ashok Patel

[57] ABSTRACT

A negative glow discharge lamp includes a light transmitting envelope containing a noble gas fill material. A pair of electrically spaced electrodes is disposed in a parallel relationship within the envelope. A pair of lead-in wires is coupled to each of the electrodes and extends through and is hermetically sealed in the envelope. A pair of wire probes is associated with each of the spaced electrodes. Each of the ends of the spaced electrodes has one of the wire probes extending beyond the electrode associated therewith and toward the other electrode. The present invention provides a negative glow discharge lamp that has improved lamp efficacy and enhanced lamp life.

5 Claims, 1 Drawing Sheet

GLOW DISCHARGE LAMP HAVING ANODE PROBES

TECHNICAL FIELD

The present invention relates in general to a compact fluorescent lamp and pertains, more particularly, to a negative glow discharge lamp containing anode probes.

BACKGROUND OF THE INVENTION

A negative glow lamp typically is comprised of a light transmitting envelope containing a noble gas and mercury with a phosphor coating on an inner surface of the envelope which is adapted to admit visible light upon absorption of ultraviolet radiation that occurs when the lamp is excited. The lamp is excited by means of the application of a voltage between the lamp electrodes. Current flows between the electrodes after a certain potential is applied to the electrodes, commonly referred to as the breakdown voltage. An elementary explanation of the phenomenon is that the gas between the electrodes becomes ionized at a certain voltage, conducts current, and emits ultraviolet radiation. Examples of typical glow discharge lamps are found in U.S. Pat. No. 2,067,129 to Marden; U.S. Pat. No. 3,814,971 to Bhattacharya; and U.S. Pat. No. 4,408,141 to Byszewski et al.

When operating commercially on alternating current, a typical fluorescent lamp will generally contain a pair of electrodes of similar construction. Each electrode will act as cathode during one-half of the cycle and as anode during the other half. To avoid overheating during the anode portion of the cycle, anode probes (sometimes referred to as auxiliary electrodes) are added to the electrode structure to collect electrons during the positive half-cycle. The anode probes are electrically connected to the ends of the electrodes.

An example of a fluorescent lamp containing anode probes is shown in U.S. Pat. No. 4,013,914, which issued to Clune et al on Mar. 22, 1977. As illustrated therein, an L-shaped wire probe (coated with a dielectric material) is electrically connected to each lead-in wire adjacent the ends of the electrode and extends parallel to the electrode.

Although the L-shaped probes of Clune et al function effectively, the L-shaped probe configuration presents several disadvantages. For example, when the probes of Clune et al are mounted in a single-ended, negative glow discharge lamp and oriented in a common plane with a pair of parallelly-spaced electrodes, a fraction of fast electrons accelerated in the cathode fall are allowed to collide into the probes prior to exciting mercury atoms. As a result, a loss in lamp efficacy occurs. Moreover, the particular probe configuration taught by Clune et al can absorb a fraction of the light generated by excited mercury atoms and can also cause a loss in lamp efficacy by decreasing the anode fall.

DISCLOSURE OF THE INVENTION

One object of the present invention is to provide an improved negative glow discharge lamp that has improved lamp efficacy and enhanced lamp life.

To accomplish the foregoing and other objects, features, and advantages of the invention, there is provided a glow discharge lamp that is comprised of a light transmitting envelope containing a noble gas fill material. A pair of electrically spaced electrodes is disposed in a parallel relationship within the envelope and has an emissive material disposed thereon. A pair of lead-in wires is coupled to each of the electrodes and extends through and is hermetically sealed in the envelope. A pair of wire probes is associated with each of the spaced electrodes. Each of the ends of the spaced electrodes has one of the wire probes extending beyond the electrode associated therewith and toward the other electrode.

In accordance with other aspects of the present invention, all of the wire probes lie in a common plane. In a preferred embodiment, the distance between opposing probes of approximately 1 to 10 millimeters. Preferably, each of the wire probes has a length equal to approximately 5 millimeters.

In accordance with further features of the invention, the envelope also contains mercury in which ultraviolet radiation is emitted upon excitation. A phosphor coating is disposed on the inner surface of the envelope for emitting visible light upon absorption of ultraviolet radiation. The noble gas fill material may comprise a mixture of neon and argon.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
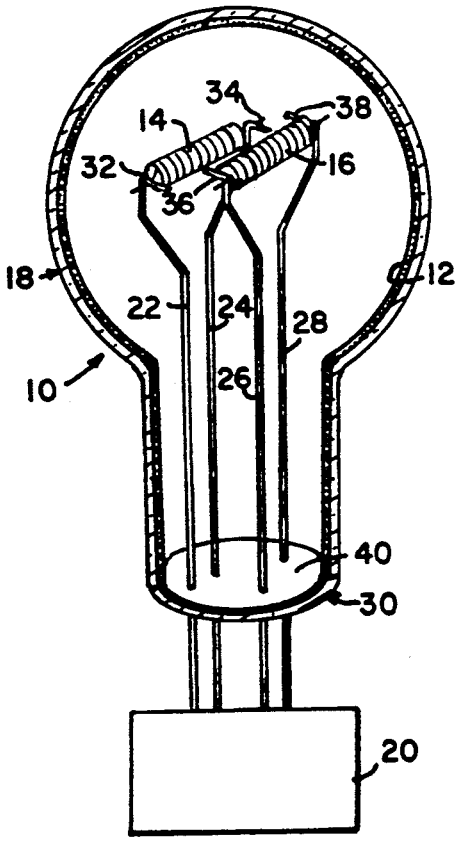
FIG. 1 is a front elevation cross-sectional view of a negative glow discharge lamp constructed in accordance with the principles of the present invention.
Figure 2:
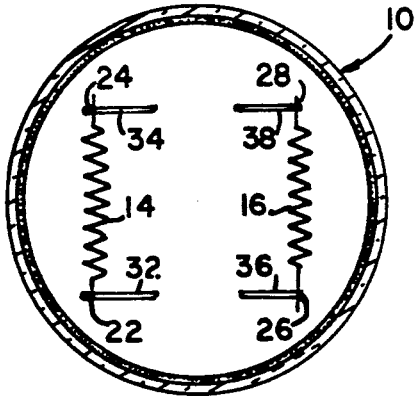
FIG. 2 is a top elevation cross-sectional view of the negative glow discharge lamp of FIG. 1.

Reference is made herein to FIGS. 1 and 2 which illustrate an AC-operated, negative glow discharge lamp including an envelope 10 that is provided with a phosphor coating as illustrated at 12. There are two emissive electrodes 14, 16 located in a parallel relationship within the most bulbous region 18 of the envelope and typically spaced approximately 1 to 3 centimeters apart. The opposing electrodes 14 and 16 are both coated with an emissive coating. The emissive coating may be comprised of, for example, 48 percent by weight of $BaCO_3$, 42.5 percent by weight of $SrCO_3$, 9.5 percent by weight of $CaCO_3$, and 5 percent by weight of $ZrO_2$. The filament electrodes are both coated since the lamp is normally driven by an alternating power source coupled to the starting and operating circuit 20 so that each electrode has to act alternately, in time, as a cathode and anode, respectively. Electrodes 14 and 16 are supported by respective lead-in wires 22, 24 and 26, 28.

In FIGS. 1 and 2, the envelope 10 is generally of spherical shape having a generally maximum cross-section bulbous region 18 and also including a neck region 30. The lead-in wires 22, 24, 26, 28 are typically hermetically sealed at the neck region 30 with a wafer stem assembly 40. The electrodes 14 and 16 are supported primarily in a parallel relationship and may be located as shown in FIG. 1 or at the maximum cross-section of bulbous region 18.

During AC operation, each electrode alternately functions as a cathode which emits electrons that are accelerated so that mercury vapor is excited in the extended region of the low pressure gas. In this connection the envelope may be filled with a conventional fill material including mercury and a noble gas or mixtures of noble gases. A suitable noble gas is neon or a mixture of neon and argon.

In accordance with the teachings of the present invention, the glow discharge lamp includes a pair of wire probes associated with each of the electrodes. As illustrated in FIGS. 1 and 2, a straight wire probe 32, 34 is located adjacent and extends from a respective end of electrode 14. Wire probes 32 and 34 are attached to or formed from lead-in wires 22 and 24, respectively. Similarly, a straight wire probe 36, 38 is located adjacent and extends from and beyond a respective end of electrode 16. Wire probes 36 and 38 are attached to or formed from lead-in wires 26 and 28, respectively. The distance between opposing pairs of probes 32, 36 and 34, 38 if preferably equal to approximately 1 to 10 millimeters.

Preferably, all of the wire probes 32, 34, 36, 38 lie in a common plane which passes through electrodes 14, 16. Each wire probe extends substantially perpendicularly from a respective lead-in wire and electrode associated therewith. The length of each probe may be approximately 5 millimeters.

It was discovered that as a result of the probes of the present invention, fewer electrons collide with the probes since they are disposed from the bulk of the accelerated electrons. Moreover, the fraction of light intercepted by the probes is diminished because of the placement of the probes. It was observed that lamps constructed with the probes of the present invention typically have an increase in efficacy of from 1 to 2 lumens per watt (LPW) higher than glow discharge lamps containing L-shaped probes. This increase in efficacy probably results from less light absorption and fewer direct electron collisions with the probes of the present invention.

Additionally, it was discovered unexpectedly that lamps constructed with the probes of the present invention can be rapid cycled more times than similar lamps made with prior known probes. For example, when performing an accelerated lifetest using a 5-minutes-ON and 5-minutes-OFF cycle, a lamp constructed with the probes of the present invention was cycled approximately 1800 times before the emissive material on the electrodes was depleted. Lamps constructed with known L-shaped probes lasted only 300 to 600 cycles before the emissive material was depleted.

Figure 3:
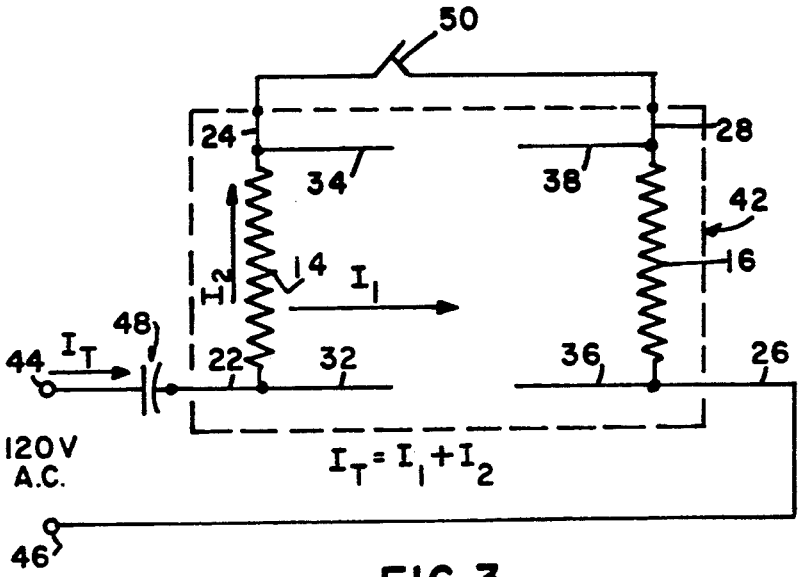
FIG. 3 is a schematic diagram illustrating the negative glow discharge lamp and operating circuit.

While the particular theory for the increase in the number of cycles before end of life is uncertain, a shunting of lamp current during the first few seconds during starting was observed. Referring now to FIG. 3, there is shown a schematic diagram of a starting and operating circuit for a negative glow discharge lamp 42. The circuit comprises input terminals 44, 46 of a source of alternating current (e.g., 120 volts) and a ballast capacitor 48 connected in series with lamp 42. The diagram of lamp 42 includes two emissive electrodes 14, 16 each having a pair of wire probes 32, 34 and 36, 38 respectively associated therewith. Lead-in wires 22, 24 and 26, 28 are connected to electrodes 14 and 16, respectively. A normally-open starter 50, such as a manual switch, glow starter or SIDAC, is connected to lead-in wires 24, 26.

During lamp starting, it was observed that a part $I_1$ of the total current $I_T$ flows in the discharge between electrodes 14 and 16 while the remaining part of the current $I_2$ flows through electrodes 14, 16 and starter 50. This observed shunting of lamp current is probably enhanced by the close proximity of opposing probes. The momentary shunting results in the lamp starting at a reduced current which beneficially causes less electrode damage.

Another possible explanation for the observed increase in cycling may be the fact that the pointed ends of the probes and higher fields created thereabout could be more effective in collecting electron current during each anode half-cycle. This prevents any overheating of the emissive coating.

In accordance with one detailed embodiment of the present invention, the lamp employs an A-23 incandescent lamp envelope internally coated with a phosphor blend. The electrode mount assembly is comprised of a multi-pin wafer stem 40 with the attached lead-in wires 22, 24, 26, 28 made of 0.020 inch diameter nickel. The electrodes 14 and 16 are clamped on the ends of each pair of lead-in wires. Each electrode is a standard #41 triple-coiled tungsten exciter available from GTE Products Corporation and is coated with an emissive material. The opposing electrodes are disposed in a parallel relationship and spaced approximately 1.5 centimeters apart. The probes are constructed of nickel wire having a 0.030 inch diameter and have a length of approximately 5 millimeters. A probe is welded to each electrode end and extends perpendicularly outward from one electrode toward an opposing electrode. The distance between opposing probes is approximately 5 millimeters.

In constructing a lamp in accordance with the present invention, the envelope is evacuated of air and heated to approximately 400° C. The cathode is activated in a vacuum by heating to approximately 1,250° C. The lamp is filled with a 3 torr mixture of neon and argon. This mixture may comprise 99.5% neon and 0.5% argon along with a drop of mercury, approximately 30 milligrams in weight. This is added before lamp tipoff.

Thus, in summary in accordance with the present invention there is provided a negative glow discharge lamp employing novel anode probes. The anode probes yield a negative glow discharge lamp with superior lamp operating life in comparison to similar lamps constructed with prior L-shaped anode probes.

While there have been shown and described what are at present considered the preferred embodiments of the invention, it will be obvious to those skilled in the art that various changes and modifications may be made therein without departing from the scope of the invention as defined by the appended claims.

What is claimed is:

1. A glow discharge lamp comprising:

a light transmitting envelope containing a noble gas fill material;

a pair of electrically spaced electrodes disposed in a parallel relationship within said envelope and having an emissive material disposed thereon, each of said pair of spaced electrodes having a pair of ends;

a pair of lead-in wires coupled to each of said pair of spaced electrodes and extending through and hermetically sealed in said envelope; and a pair of wire probes associated with each of said pair of spaced electrodes, each of said pair of ends having one of said pair of wire probes extending beyond one of said pair of spaced electrodes associated therewith and toward the other pair of wire probes of the other electrode, wherein said one of said pair of wire probes is separated from said other pair of wire probes by an approximate distance of 1 to 10 millimeters.

2. The glow discharge lamp as set forth in claim 1 wherein all of said pair of wire probes lie in a common plane.

3. The glow discharge lamp as set forth in claim 1 wherein each of said pair of wire probes has a length equal to approximately 5 millimeters.

4. The glow discharge lamp as set forth in claim 1 wherein the envelope also contains mercury and emits ultraviolet radiation upon excitation.

5. The glow discharge lamp as set forth in claim 4 including a phosphor coating on an inner surface of said envelope and which emits visible light upon absorption of said ultraviolet radiation.

* * * * *